US005395011A

United States Patent [19]

Kennedy

[11] Patent Number: 5,395,011

[45] Date of Patent: Mar. 7, 1995

[54] MOUNTABLE BEVERAGE COOLERS AND DISPENSER SYSTEMS

[76] Inventor: Kevin E. Kennedy, 215 W. 5500 S., Wash Terr., Utah 84405

[21] Appl. No.: 210,432

[22] Filed: Mar. 21, 1994

[51] Int. Cl.[6] ..... A47F 1/18

[52] U.S. Cl. ..... 221/96; 221/87; 221/89; 221/97; 221/150 R; 221/185; 221/199; 222/192

[58] Field of Search ..... 221/87, 89, 96, 97, 221/105 R, 185, 199; 222/131, 185, 192

[56] References Cited

U.S. PATENT DOCUMENTS

| | | | |
|---|---|---|---|
| Re. 18,291 | 12/1931 | Kaye | 221/97 |
| 1,594,248 | 7/1926 | Efstathiou | 222/131 X |
| 2,716,508 | 8/1955 | Booth | 222/131 |
| 3,349,960 | 10/1967 | Ketler | 221/96 |
| 3,604,592 | 9/1971 | Bacon et al. | 221/96 |
| 3,605,435 | 9/1971 | Taylor | 221/89 X |
| 4,162,029 | 7/1979 | Gottsegen et al. | 221/131 |
| 5,000,343 | 3/1991 | Allen | 221/199 X |
| 5,222,631 | 6/1993 | Hood | 222/131 |

FOREIGN PATENT DOCUMENTS

| | | | |
|---|---|---|---|
| 309829 | 4/1929 | United Kingdom | 221/97 X |

*Primary Examiner*—Robert P. Olszewski
*Assistant Examiner*—Dean A. Reichard

[57] ABSTRACT

A mountable beverage cooler and dispenser system comprising a housing with a vertically positioned cylindrical wall. The housing has a circular planar roof and floor, and a diameter which exceeds the height. The housing wall includes a generally rectangular large aperture. The large aperture also includes a small aperture which extends downward,toward the floor further than the majority of the large aperture. A generally rectangular shaped sliding door is contoured to follow the perimeter of the housing. The door is positioned between the tray discussed below and the wall of the housing so that it may be maneuvered to cover the large and small apertures. A generally cylindrically shaped tray consists of a circular planar floor with upstanding sidewalls forming a hollow central section therebetween. The height of the tray sidewalls is approximately the height of the housing sidewalls beneath the large aperture. The diameter of the tray and planar floor are slightly smaller than that of the housing. The central section is shaped in the configuration of a cylinder with large, equidistantly spaced, vertically disposed, U-shaped indentations contiguous with the perimeter. The tray is positioned within the housing resting upon the floor thereof. A tray lid covers only the hollow portion of the central section and includes large, equidistantly spaced, U-shaped indentations essentially contiguous with the perimeter of the tray. The lid is positioned on top of the analogously contoured tray, and includes depressions to aid in removal by the user.

6 Claims, 3 Drawing Sheets

MOUNTABLE BEVERAGE COOLERS AND DISPENSER SYSTEMS

BACKGROUND OF THE INVENTION

1. Field of the Invention

The present invention relates to mountable beverage cooler and dispenser systems and more particularly pertains to mounting beverage cooler and dispenser systems on golf bags or carts to aid in transport on golf courses.

2. Description of the Prior Art

The use of beverage coolers is known in the prior art. More specifically, beverage coolers heretofore devised and utilized for the purpose of containing and preserving cold beverages are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,459,827 to Rhodes, a golf bag cooler kit.

U.S. Pat. No. 4,924,682 to Penner discloses a golf bag beverage cooler.

U.S. Pat. No. 5,022,549 to Beaver discloses a collapsible beverage cooler holder.

U.S. Pat. No. Des. 311,300 to Anderson discloses the ornamental design for a golf bag cooler pack.

U.S. Pat. No. Des. 330,631 to Ledbetter discloses the ornamental design for a combined golf bag and cooler.

U.S. Pat. No. Des. 293,851 to Cannon et al. discloses the ornamental design for an insulated cooler compartment for a golf bag.

In this respect, the mountable beverage cooler and dispenser systems according to the present invention substantially departs from the conventional concepts and designs of the prior art, and in doing so provides an apparatus primarily developed for the purpose of mounting beverage cooler and dispenser systems on golf bags or carts to aid in transport on golf courses.

Therefore, it can be appreciated that there exists a continuing need for new and improved mountable beverage cooler and dispenser systems which can be used for mounting beverage cooler and dispenser systems on golf bags or carts to aid in transport on golf courses. In this regard, the present invention substantially fulfills this need.

SUMMARY OF THE INVENTION

In view of the foregoing disadvantages inherent in the known types of beverage coolers now present in the prior art, the present invention provides an improved mountable beverage cooler and dispenser system. As such, the general purpose of the present invention, which will be described subsequently in greater detail, is to provide a new and improved mountable beverage cooler and dispenser system and method which has all the advantages of the prior art and none of the disadvantages.

To attain this, the present invention essentially comprises a new and improved mountable beverage cooler and dispenser system comprising a housing with a vertically positioned cylindrical wall. The housing has a circular planar roof attachable thereto, and a circular planar floor. The diameter of the housing exceeds the height. The housing wall includes a generally rectangular large aperture in the upper extent extending approximately one-half of the height and approximately one-half of the circumference of the housing. The large aperture includes a centrally located small aperture which extends downward toward the floor further than the majority of the large aperture. A small semi-circular lip having a hole therethrough is located at the center point of a vertical side edge of the large aperture. A generally rectangular shaped sliding door has parallel vertical sides and parallel horizontal sides. The plane of the door is contoured to follow the perimeter of the housing. The door is positioned between the tray and the wall of the housing so that it may be maneuvered to cover the large and small apertures. The door includes a small semi-circular lip with a hole therethrough located on a vertical side edge about one-third of the distance from the upper extent. A generally cylindrically shaped tray consists of a circular planar floor with upstanding sidewalls forming a hollow central section therebetween. The height of the tray sidewalls are about the height of the housing sidewalls beneath the large aperture. The diameter of the tray and planar floor are slightly smaller than that of the housing. The central section is shaped in the configuration of a cylinder with five large, equidistantly spaced, vertically disposed, U-shaped indentations contiguous with the perimeter. The tray is positioned within the housing resting upon the floor thereof. A tray lid is shaped to cover only the hollow portion of the central section. The lid includes five large, equidistantly spaced, U-shaped indentations essentially contiguous with the perimeter of the tray. The lid is positioned to be located upon the top of the analogously contoured tray. The lid includes two centrally located, semi-circular shaped depressions separated by a small space. A generally cylindrically shaped insert tank is designed to fit into the space in the housing above the tray. The insert tank has cylindrically shaped walls forming a hollow chamber and an extended portion extending downward to conform to the shape of the small aperture in the housing. The extended portion includes a spigot for regulating beverage flow located at its center point. The insert tank has a floor which is contiguous with the lower extent of the cylindrical wall, and an opening at its upper extent. A cap for the insert tank is adapted to cover its opening. The cap includes two centrally located, semi-circular shaped depressions separated by a small space. Two buckles are affixed near the upper extent of the housing, each buckle consisting of a base piece with screw holes, and a rectangular loop connected to the base piece. A thin, circular shaped bag mounting belt has a diameter slightly larger than that of the housing and a short vertical height. The belt includes two hook accessories attached to the belt at diametric opposite ends in operative proximity to the buckles. The belt also includes a plurality of screw hole apertures throughout its circumference. A plurality of screws extend through the apertures to secure the belt to the housing. The belt is adapted to be secured to the bottom of a golf bag.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved mountable beverage cooler and dispenser systems which have all the advantages of the prior art beverage coolers and none of the disadvantages.

It is another object of the present invention to provide new and improved mountable beverage cooler and dispenser systems which may be easily and efficiently manufactured and marketed.

It is a further object of the present invention to provide new and improved mountable beverage cooler and dispenser systems which are of durable and reliable constructions.

An even further object of the present invention is to provide new and improved mountable beverage cooler and dispenser systems which are susceptible of a low cost of manufacture with regard to both materials and labor, and which accordingly are then susceptible of low prices of sale to the consuming public, thereby making such mountable beverage cooler and dispenser systems economically available to the buying public.

Still yet another object of the present invention is to provide new and improved mountable beverage cooler and dispenser systems which provide in the apparatuses and methods of the prior art some of the advantages thereof, while simultaneously overcoming some of the disadvantages normally associated therewith.

Still another object of the present invention is to provide beverage cooler and dispenser systems which may be mounted on golf bags or carts to aid in transport on golf courses.

Lastly, it is an object of the present invention to provide new and improved mountable beverage cooler and dispenser systems comprising a housing with a vertically positioned cylindrical wall. The housing has a circular planar roof and floor, and a diameter which exceeds the height. The housing wall includes a generally rectangular large aperture. The large aperture also includes a small aperture which extends downward toward the floor further than the majority of the large aperture. A generally rectangular shaped sliding door is contoured to follow the perimeter of the housing. The door is positioned between the tray and the wall of the housing so that it may be maneuvered to cover the large and small apertures. A generally cylindrically shaped tray consists of a circular planar floor with upstanding sidewalls forming a hollow central section therebetween. The height of the tray sidewalls approximate the height of the housing sidewalls beneath the large aperture. The diameter of the tray and planar floor are slightly smaller than that of the housing. The central section is shaped in the configuration of a cylinder with large, equidistantly spaced, vertically disposed, U-shaped indentations contiguous with the perimeter. The tray is positioned within the housing resting upon the floor thereof. A tray lid covers only the hollow portion of the central section and includes large, equidistantly spaced, U-shaped indentations essentially contiguous with the perimeter of the tray. The lid is positioned on top of the analogously contoured tray, and includes depressions to aid in removal by the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 2:
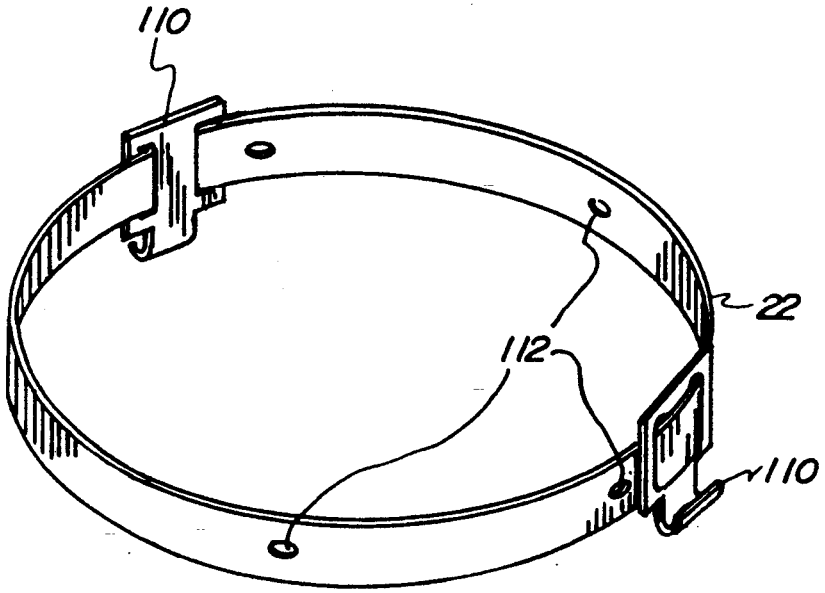
FIG. 2 is a perspective view of a detached bag mounting belt.
Figure 1:
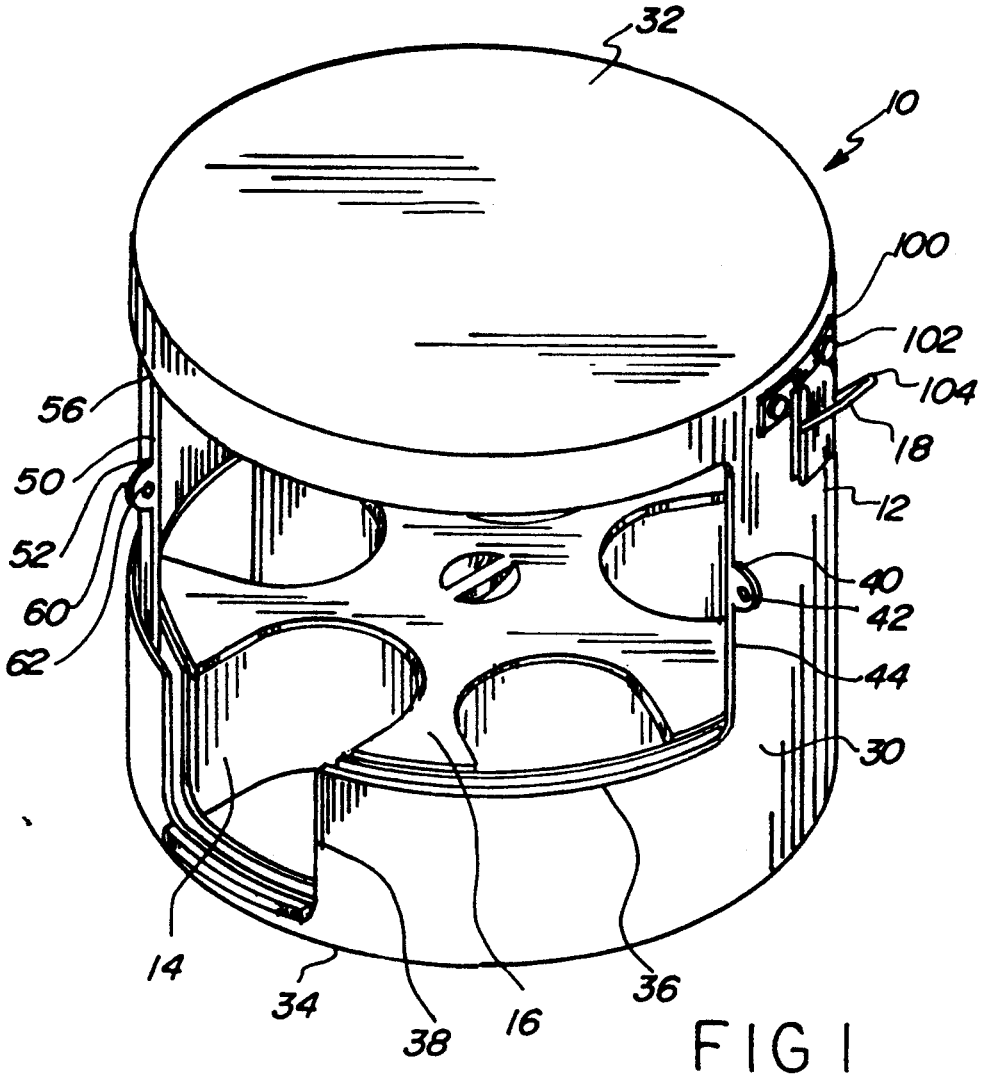
FIG. 1 is a perspective view of the preferred embodiment of the mountable beverage cooler and dispenser systems constructed in accordance with the principles of the present invention.
Figure 3:
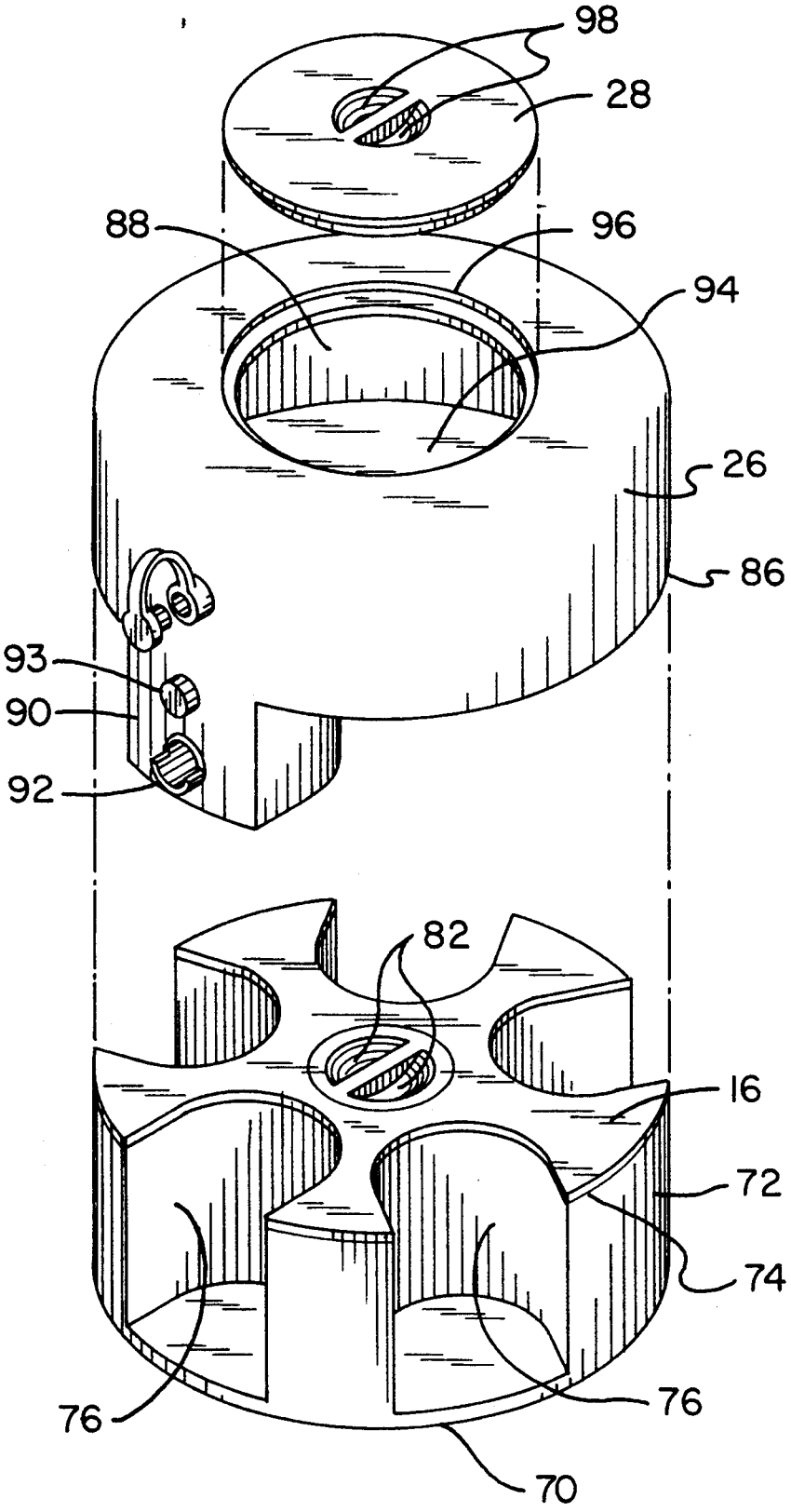
FIG. 3 is an exploded view of the insert tank and tray with their corresponding covers.
Figure 4:
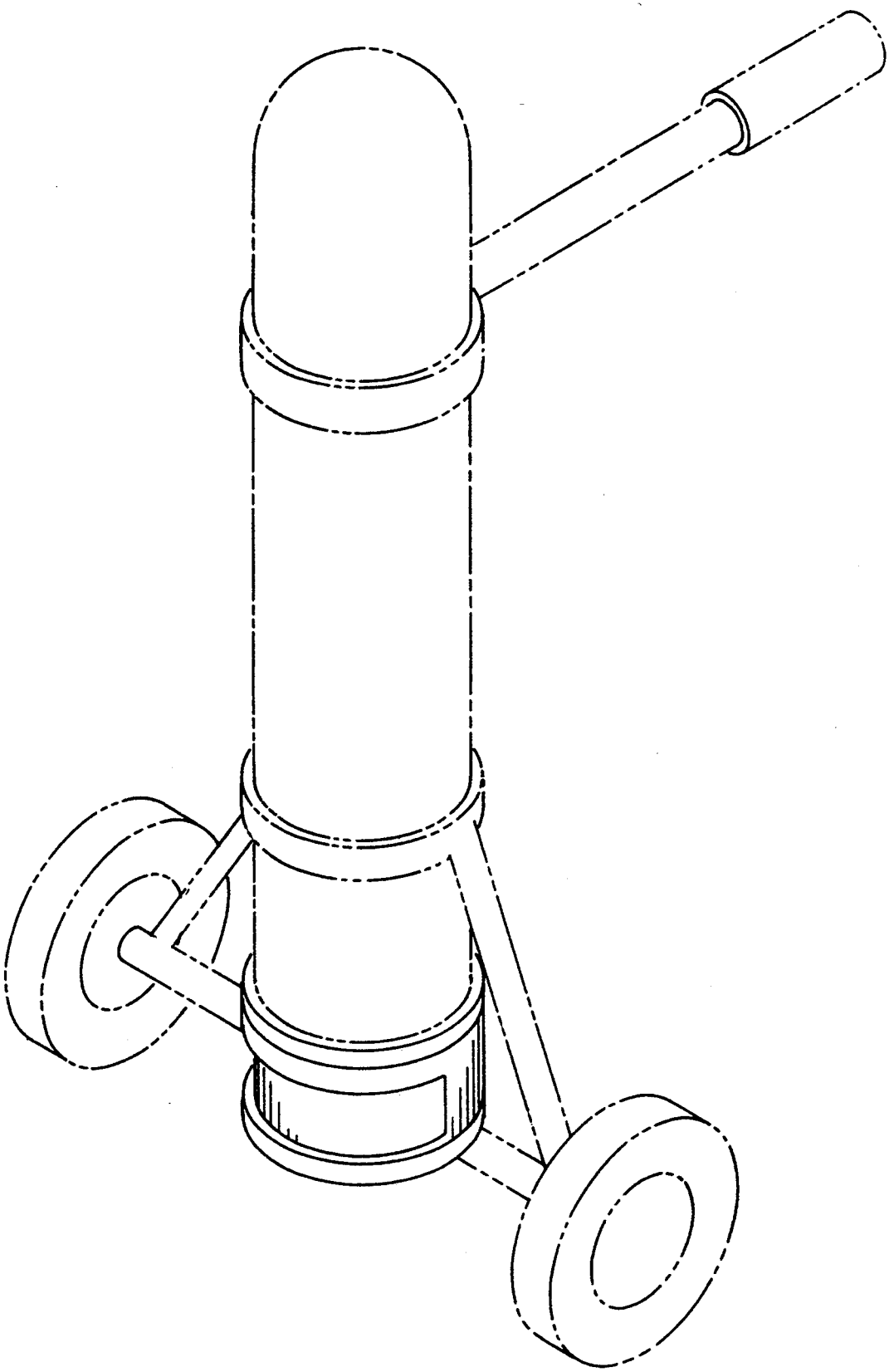
FIG. 4 is a reduced perspective view of the beverage cooler and dispenser system affixed to the bottom of a golf bag and positioned in a golf pull-cart.

With reference now to the drawings, and in particular to FIG. 1 thereof, the preferred embodiment of the new and improved mountable beverage cooler and dispenser systems embodying the principles and concepts of the present invention and generally designated by the reference numeral 10 will be described.

Specifically, it will be noted in FIGS. 1 through 6, that there is provided a new and improved mountable beverage cooler and dispenser system 10. The beverage cooler and dispenser system 10, in its broadest context, comprises a housing 12, a tray 14, a tray lid 16, two buckles 18, a bag mounting belt 22, a golf cart mounting device, an insert tank 26 and an insert tank cap 28.

More specifically, the housing 12 has a vertically positioned cylindrical wall 30. The housing 12 has a circular planar roof 32 attachable thereto, and a circular planar floor 34. The diameter of the housing 12 exceeds the height. The housing 12 wall includes a generally rectangular large aperture 36 in the upper extent extending approximately one-half of the height and approximately one-half of the circumference of the housing 12. The large aperture 36 includes a centrally located small aperture 38 which extends downward toward the floor 34 further than the majority of the large aperture 36. A small semi-circular lip 40 having a hole 42 therethrough is located at the center point of a vertical side edge 44 of the large aperture.

A generally rectangular shaped sliding door 50 has parallel vertical sides 52 and parallel horizontal sides 56. The plane of the door 50 is contoured to follow the perimeter of the housing 12. The door 50 is positioned between the tray 14 and the wall 30 of the housing so that it may be maneuvered to cover the large 36 and small apertures 38. The door 50 includes a small semi-circular lip 60 with a hole 62 therethrough located on a vertical side edge 52 about one-third of the distance from the upper extent.

A generally cylindrically shaped tray 14 consists of a circular planar floor 70 with upstanding sidewalls 72 forming a hollow central section 74 therebetween. The height of the tray sidewalls 72 are about the height of the housing sidewall 30 beneath the large aperture 36. The diameter of the tray 14 and planar floor 34 are slightly smaller than that of the housing 12. The central section 74 is shaped in the configuration of a cylinder with five large, equidistantly spaced, vertically disposed, U-shaped indentations 76 contiguous with the perimeter. The tray 14 is positioned within the housing 12 resting upon the floor 34 thereof.

A tray lid 16 is shaped to cover only the hollow portion of the central section 74. The lid 16 includes five large, equidistantly spaced, U-shaped indentations essentially contiguous with the perimeter of the tray. The lid 16 is positioned to be located upon the top of the analogously contoured tray 14. The lid 16 includes two centrally located, semi-circular shaped depressions 82 separated by a small space to assist in lifting.

A generally cylindrically shaped insert tank 26 is designed to fit into the space in the housing 12 above the tray 14. The insert tank 26 has cylindrically shaped walls 86 forming a hollow chamber 88 and an extended portion 90 extending downward to conform to the shape of the small aperture 38 in the housing 12. The extended portion 90 includes a spigot 92 with a flow regulating button 93 for regulating beverage flow located at its center point. The insert tank 26 has a floor 94 which is contiguous with the lower extent of the cylindrical wall 86, and an opening 96 at its upper extent.

A cap 28 for the insert tank is adapted to cover its opening 96. The cap 28 includes two centrally located, semi-circular shaped depressions 98 separated by a small space to assist in lifting.

Two buckles 18 are affixed near the upper extent of the housing 12, each buckle consisting of a base piece 100 with screw holes 102, and a rectangular loop 104 connected to the base piece 100.

A thin, circular shaped bag mounting belt 22 has a diameter slightly larger than that of the housing 12 and a short vertical height. The belt 22 includes two hook accessories 110 attached to the belt 22 at diametric opposite ends in operative proximity to the buckles 18. The belt 22 also includes a plurality of screw hole apertures 112 throughout its circumference. A plurality of screws extend through the apertures 112 to secure the belt 22 to the housing 12. The belt 22 is adapted to be secured to the bottom of a golf bag.

The mountable beverage cooler and dispenser systems are designed to be used on golf courses. The apparatus may be mounted on a golf pull-cart or on the back of a motorized golf cart. When mounting on a golf pull-cart, a golf bag is positioned on top of the apparatus, with the apparatus positioned in the bottom of the pull-cart. The apparatus serves two purposes. One purpose is to keep beverages cool. This objective is accomplished by filling the hollow portion of the tray with regular ice or blue ice. The ice keeps beverage cans placed in the U-shaped indentations very cold. Beverage cans located in the tray are easily selected and removed by the user by rotating the tray. The insert tank may be utilized in place of cans if the user desires something other than canned beverages. The contents of the insert tank are kept very cold when placed on top of the tray, securely within the analogously contoured apertures of the housing. The contents of the tank are easily removed by manipulating the conveniently located spigot.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mountable beverage cooler and dispenser system comprising, in combination:

a housing with a vertically positioned cylindrical wall defining for said housing a circumference, a height, an upper extent, and a lower extent, with a circular planar roof attachable thereto and a circular planar floor, the diameter of the housing exceeding the height, with a generally rectangular large aperture in the upper extent of the housing wall extending approximately one-half of the height and approximately one-half of the circumference of the housing, the large aperture including a centrally located small aperture which extends downward toward the floor further than the majority of the large aperture, with a small semi-circular lip having a hole therethrough located at a center point of a vertical side edge of the large aperture;

a generally cylindrically shaped tray having a predetermined circumference and diameter consisting of a circular planar floor with upstanding sidewalls having a predetermined height forming a hollow central portion therebetween, the height of the tray sidewalls being about the height of the housing beneath the large aperture, with the diameter of the tray and planar floor being slightly smaller than that of the housing, the central portion shaped in the configuration of a cylinder with five large, equidistantly spaced, vertically disposed, U-shaped indentations contiguous with the circumference of said tray, the tray being positioned within the housing resting upon the floor thereof;

a generally rectangular shaped sliding door with parallel vertical sides and parallel generally horizontal sides, a shape of the door contoured rather than planar to follow the circumference of the housing and positioned between the tray and the wall of the housing so that it may be maneuvered to cover the large and small apertures, the door including a small semi-circular lip with a hole therethrough located on a vertical side edge of said door;

a tray lid shaped to cover only the hollow central portion, the lid including five large, equidistantly spaced, U-shaped indentations essentially contiguous with the circumference of the tray, and positioned to be located upon the top of the tray, the lid including two centrally located, semi-circular shaped depressions separated by a small space;

a generally cylindrically shaped insert tank designed to fit into a space in the housing above the tray, the insert tank having a cylindrically shaped wall with an upper section and a lower section forming a hollow chamber, with an extended portion extending downward to conform to the shape of the small aperture in the housing, the extended portion including a spigot for regulating beverage flow located at a central point thereof, the insert tank having a floor which is contiguous with the lower section of the cylindrical wall, and an opening at its upper section;

a cap for the insert tank adapted to cover its opening, the cap including two centrally located, semi-circular shaped depressions separated by a small space;

two buckles affixed near the upper extent of the housing, each buckle consisting of a base piece with screw holes, and a rectangular loop connected to the base piece; and a thin, circular shaped bag mounting belt with a diameter slightly larger than that of the housing and a short vertical height, the belt including two hook accessories attached to the belt at diametric opposite ends in operative proximity to the buckles, the belt also including a plurality of screw hole apertures throughout its circumference, with a plurality of screws extending through the apertures to secure the belt to the housing, the belt adapted to be secured to the bottom of a golf bag.

2. A mountable beverage cooler and dispenser system comprising:

a housing with a vertically positioned cylindrical wall defining for said housing a circumference, a height, an upper extent, and a lower extent, with a circular planar roof a circular planar floor, the diameter of the housing exceeding the height, with a generally rectangular large aperture in the housing wall, the large aperture also including a small aperture which extends downward toward the floor further than the majority of the large aperture;

a generally cylindrically shaped tray having a predetermined circumference and diameter consisting of a circular planar floor with upstanding sidewalls having a predetermined height forming a hollow central portion therebetween, the height of the tray sidewalls being about the height of the housing beneath the large aperture, with the diameter of the tray and planar floor being slightly smaller than that of the housing, the central portion shaped in the configuration of a cylinder with large, equidistantly spaced, vertically disposed, U-shaped indentations contiguous with the circumference of said tray, the tray being positioned within the housing resting upon the floor thereof; and a generally rectangular shaped sliding door with parallel vertical sides and parallel generally horizontal sides, a shape of the door contoured rather than planar to follow the circumference of the housing and positioned between the tray and the wall of the housing so that it may be maneuvered to cover the large and small apertures, the door including a small semi-circular lip with a hole therethrough located on a vertical side edge of said door;

a tray lid shaped to cover only the hollow central portion, the lid including large, equidistantly spaced, U-shaped indentations essentially contiguous with the circumference of the tray, and positioned to be located upon the top of the tray, the lid including depressions to aid in removal by the user.

3. The mountable beverage cooler and dispenser system as set forth in claim 2 and further including:

a generally cylindrically shaped insert tank designed to fit into the space in a housing above the tray, the insert tank having a cylindrically shaped wall with an upper section and a lower section forming a hollow chamber, with an extended portion extending downward to conform to the shape of the small aperture in the housing, the extended portion including a spigot for regulating beverage flow located at a central point thereof, the insert tank having a floor which is contiguous with the lower section of the cylindrical wall, and an opening at its upper section.

4. The mountable beverage cooler and dispenser system set forth in claim 3 and further including:

a cap for the insert tank adapted to cover its opening, the cap including depressions to aid in removal by the user.

5. The mountable beverage cooler and dispenser system set forth in claim 2 and further including:

two buckles affixed near the upper extent of the housing, each buckle consisting of a base piece with screw holes, and a rectangular loop connected to the base piece.

6. The mountable beverage cooler and dispenser system set forth in claim 5 and further including:

a thin, circular shaped bag mounting belt with a diameter slightly larger than that of the housing and a short vertical height, the belt including two hook accessories attached to the belt at diametric opposite ends in operative proximity to the buckles, the belt also including a plurality of screw hole apertures throughout its circumference, with a plurality of screws extending through the apertures to secure the belt to the housing, the belt adapted to be secured to the bottom of a golf bag.

* * * * *